United States Patent [19]

Lopez

[11] Patent Number: 5,011,071

[45] Date of Patent: Apr. 30, 1991

[54] CARTON

[76] Inventor: Louis Lopez, 214 Pleasant St., Leominster, Mass. 01453

[21] Appl. No.: 377,726

[22] Filed: Jul. 10, 1989

[51] Int. Cl.[5] ..... B65D 5/36

[52] U.S. Cl. ..... 229/117; 220/416; 229/129

[58] Field of Search ..... 229/41 R, 41 B, 117, 229/129; 220/416

[56] References Cited

U.S. PATENT DOCUMENTS

| | | | |
|---|---|---|---|
| 2,577,588 | 12/1951 | Paige | 229/41 B |
| 2,706,591 | 4/1955 | Sheard | 229/DIG. 9 |
| 2,843,308 | 7/1958 | Paige | 229/41 B |
| 3,278,108 | 10/1966 | Paige | 220/416 |
| 3,371,844 | 3/1968 | Perella | 229/41 R |
| 3,430,840 | 3/1969 | Paige | 229/41 B |
| 4,182,477 | 1/1980 | Paige | 229/41 B |
| 4,325,493 | 4/1982 | Paige | 229/41 B |
| 4,795,081 | 1/1989 | Miller | 229/129 |

*Primary Examiner*—Gary Elkins

*Attorney, Agent, or Firm*—Norman S. Blodgett; Gerry A. Blodgett

[57] ABSTRACT

Carton consisting of two telescoping cartons which movable from a non-coextensive position in which the carton is relatively flat to a coextensive position in which the carton is erected and usable.

4 Claims, 6 Drawing Sheets

CARTON

BACKGROUND OF THE INVENTION

In the design and construction of corrugated board cartons and containers, it is common practice to provide for the carton to be collapsible. That is to say, the carton is capable of being in a flat, non-usable condition and movable by certain manipulations to an erected, usable condition, in which condition it can be used for the purpose for which it is intended. One type of carton which is particularly useful is the type shown and described in the patent of Paige, U.S. Pat. No. 4,325,493 in which two shells are telescopingly arranged relative to one another and are joined by strips which ultimately become the bottom of the erected carton. Other patents or Paige which show this type of carton are U.S. Pat. Nos. 2,577,588; 2,843,308; 3,278,108; 3,430,840; and 4,406,380. Attempts have been made in the past to improve the construction shown in these patents in such a way that the resulting carton is not only stronger but also can be made by a straight-through operation. In other words, the desirable situation would be one in which the carton blank passes continuously in a single direction through a machine for constructing corrugated board cartons. These and other difficulties of the prior art have been obviated in a novel manner by the present invention.

It is, therefore, an outstanding object of the invention to provide a carton having two telescoping shells with strips joining them that ultimately form the bottom of the carton, wherein the bottom thus formed is very strong.

Another object of this invention is the provision of a carton of the telescoping shell-type which can be manufactured by a continuous straight movement through a manufacturing machine.

A further object of the present invention is the provision of a carton of the telescoping shell-type that permits a straight-through manufacturing operation in which the carton blank is not turned.

It is another object of the instant invention to provide a carton of the telescoping shell-type which is simple in construction, which is inexpensive to manufacture, and which is capable of a long life of useful service.

Another object of the invention is the provision of a telescoping-type carton which can be manufactured by introducing the blank to a carton-making machine without prior operations and is a continuous movement in which the blank is neither stopped nor turned.

With these and other objects in view, as will be apparent to those skilled in the art, the invention resides in the combination of parts set forth in the specification and covered by the claims appended hereto.

SUMMARY OF THE INVENTION

In general, the carton consists of an inner and outer snugly-nesting tubular shells of corrugated board. The outer shell consists of four side wall panels hingedly connected together along their side edges lengthwise of the lines of corrugation. The inner shell also has four side wall panels. The shells are movable into and out of a set-up relationship in which the overlying side wall panels provide for a double-walled construction. A plurality of foldable strips are hingedly connected to the bottom edges of each set of overlying side wall panels. Third strips are unfolded and act as extensions of their respective side wall panels when the inner shell is non-coextensive with the outer shell to the maximum extent. The strips extend transversely of the side wall panels to form a carton floor when said shells are telescoped into set-up relationship. Reinforcing tabs are hingedly connected to each of two alternate strips. Each tab being fastened to one of the two non-tabbed strips.

More specifically, each reinforcing tab is of generally quadrilateral shape with one side hingedly connected to an inclined side of one of two trapezoidal panels making up its strip and each reinforcing tab being fastened in face-to-face relationship to its non-tabbed strip by adhesive.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
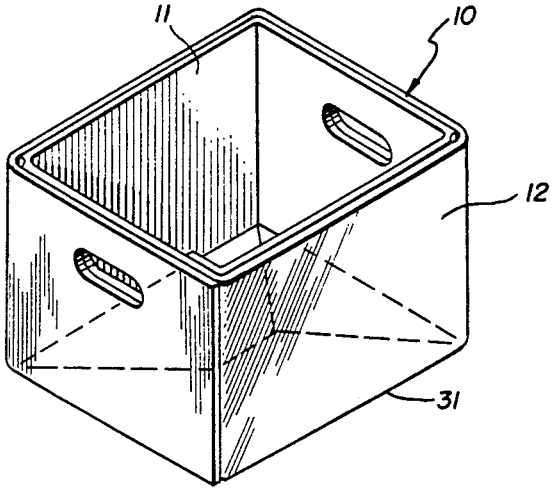
FIG. 1 is a perspective view of the carton embodying the principles of the present invention shown in the set-up mode.
Figure 2:
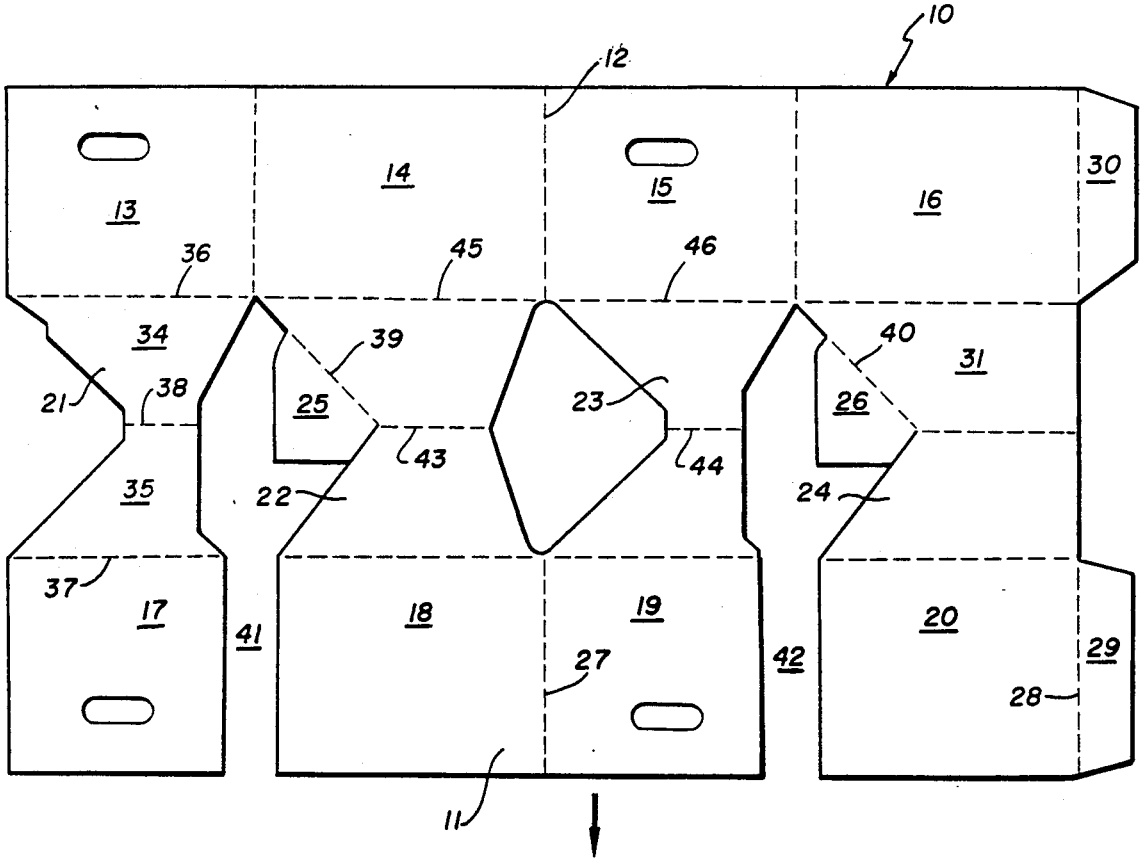
FIG. 2 is a plan view of a blank for forming the present invention.

Referring first to FIGS. 1 and 2, in which are best shown the general features of the invention, the carton, indicated generally by the reference 10, is shown in the set-up mode in FIG. 1 and in the initial blank condition before manufacture in FIG. 2.

The carton 10 comprises an inner tubular shell 11 which is snugly nested with an outer tubular shell 12, both shells being formed of corrugated board with the corrugations running vertically. The outer shell 12 consists of four side wall panels 13, 14, 15, and 16 which are hingedly connected together along their side edges lengthwise of the lines of corrugation. The hinge between the side wall panels 13 and 16 of the outer shell 12 is provided by means of the tab 30. The inner shell 11 also has four side wall panels 17, 18, 19, and 20, but only the side wall panels 18 and 19 are hinged together along the line 27 and the side wall panels 17 and 20 of the inner shell are hinged along a hinged line 28 by means of a tab 29.

Figure 6:
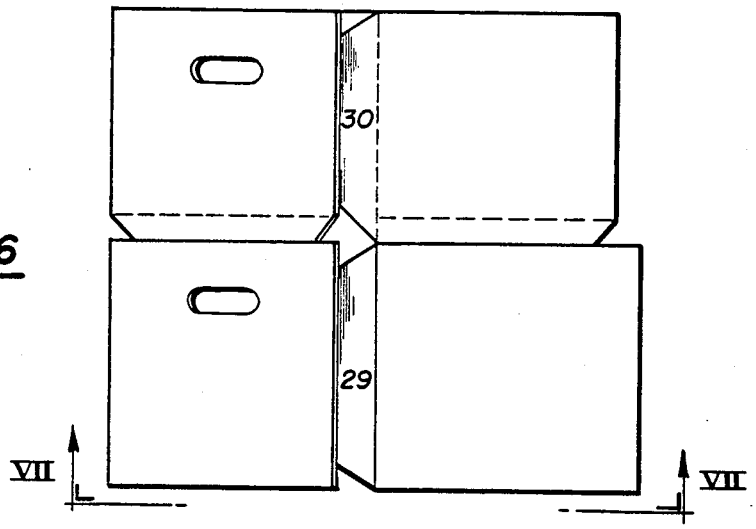
Figure 10:
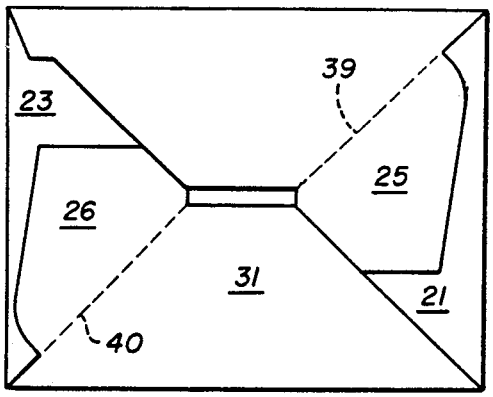
FIG. 10 is bottom plan view of the carton in set-up condition.

The plurality of foldable strips 21, 22, 23, and 24 provided hingedly connecting adjacent bottom edges of each set of overlying side wall panels. For instance, the strip 21 joins the panels 13 and 17, the strip 22 joins the panels 14 and 18, the strip 23 joins the panels 15 and 19, while the strip 24 joins the panels 16 and 20. These strips are capable of being unfolded to act as extensions of their respective side wall panels, when the inner shell 11 is non-coextensive with the outer shell 12 to the maximum extent (as shown in FIG. 6). The same strips extend transversely of the side wall panels to form a carton floor 31 (FIG. 10). The shells 11 and 12 telescoped into set-up relationship as shown in FIG. 1.

It is shown in FIG. 2, reinforcing tabs 25 and 26 are hingedly connected to each of two alternate strips 22 and 24, respectively. Each tab is fastened to one of the two non-tabs strips 21 and 23, respectively (see FIG. 10).

It is evident in FIG. 2, each of the strips 21, 22, 23, and 24 consists of two trapezoidal panels, each having its major base edge hingedly connected to a side wall panel and its minor base edge connected to the corresponding minor base edge of the other trapezoidal panel of its own strip. As an example, the strip 21 consists of two trapezoidal panels 34 and 35, the panel 34 having a base edge hinged along the line 36 while the base edge of the trapezoidal panel 35 is connected to the side wall panel 17 along the line 37. Two panels 34 and 35 are hingedly joined along the line 38 with certain variations. This is the similar situation between the strip 22 and the side wall panels 14 and 18, between the strip 23 and its side wall panels 15 and 19, and between the strip 24 and its side wall panels 16 and 20.

In FIG. 2, each reinforcing tab 25 and 26 is shown as generally quadrilateral shape with one side hingedly connected to an inclined side of one of the trapezoidal panels of its strip; the tab 25 is joined to the strip 22 to its strip 24 along the inclined hinge line 40.

As has been stated, all of the side wall panels 13, 14, 15, and 16 are joined together by hinge lines. In the case of the side wall panels 17, 18, 19, and 20 of the inner shell 11, however, the situation is different. The adjacent side wall panels 18 and 19 are joined along the hinge line 27, while the side wall panels 17 and 20 are joined along the hinge line 28 by virtue of the tab 29 being cemented to the panel 17. However, between the side wall panels 17 and 18, exists a substantial gap 41 and a similar gap 42 exists between the side wall panels 19 and 20.

Figure 3:
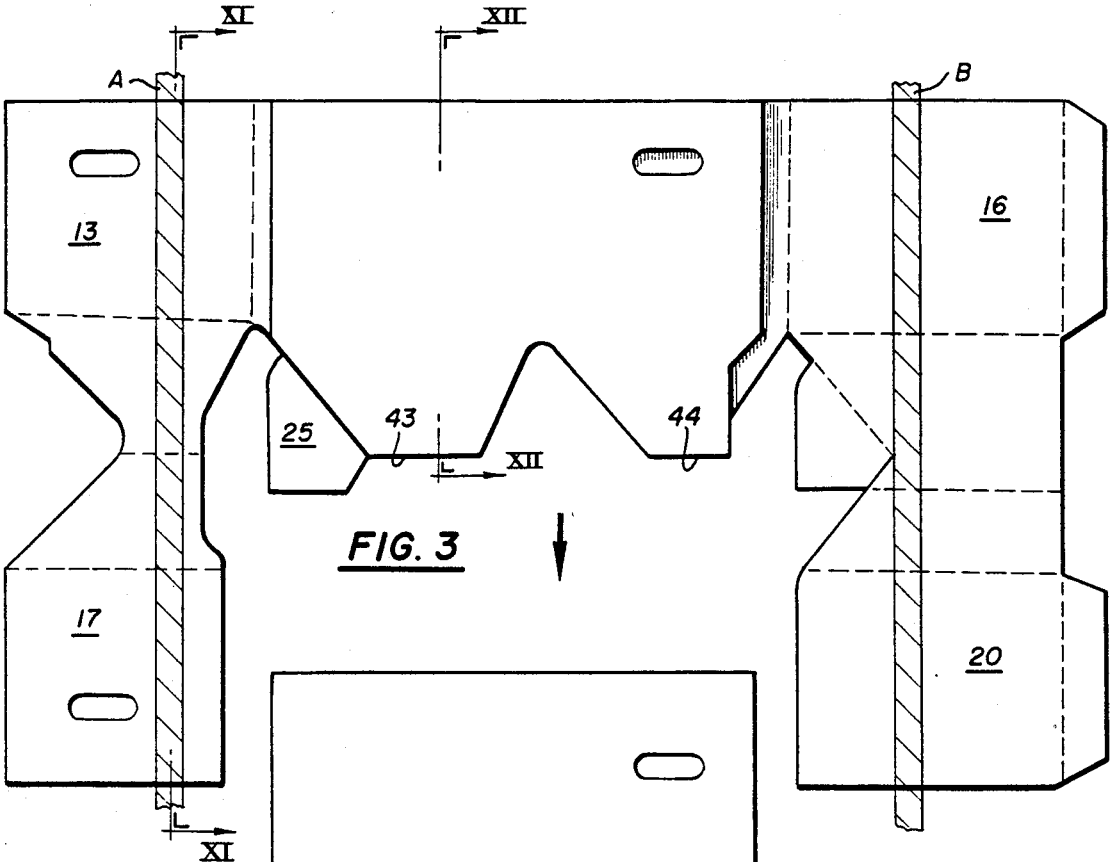
FIGS. 3, 4, 5, and 6 are plan views of the blank in various stages of its manufacture into a carton.

In order to understand the method of construction of the carton, one must first examine FIG. 2 which shows the completed blank which has been manufactured in the usual way by stamping from corrugated board. The board is arranged so that the lines of corrugation extend in the direction indicated by the arrow at the bottom of the drawing and this is the direction in which the blank is introduced into a straight-through carton manufacturing machine, such as the machine manufactured by Post; this machine has a width of seventy-four inches and is known by the trademark "Electrafold". After the introduction of the blank into the machine, the first step is shown in FIG. 3, in which the panels 18 and 19 are folded back around the hinge lines 43 and 44 in the strips 22 and 23, respectively. This is done by the use of pressure on areas A and B, which hold the panels 13 and 17 on the one hand and the panels 16 and 20 on the other hand, firmly in place during movement through the machine. The manner in which this is accomplished is shown more clearly in FIG. 11 in which the blank is shown moving through the machine under the impetus of the belts 43 and 44.

Figure 4:
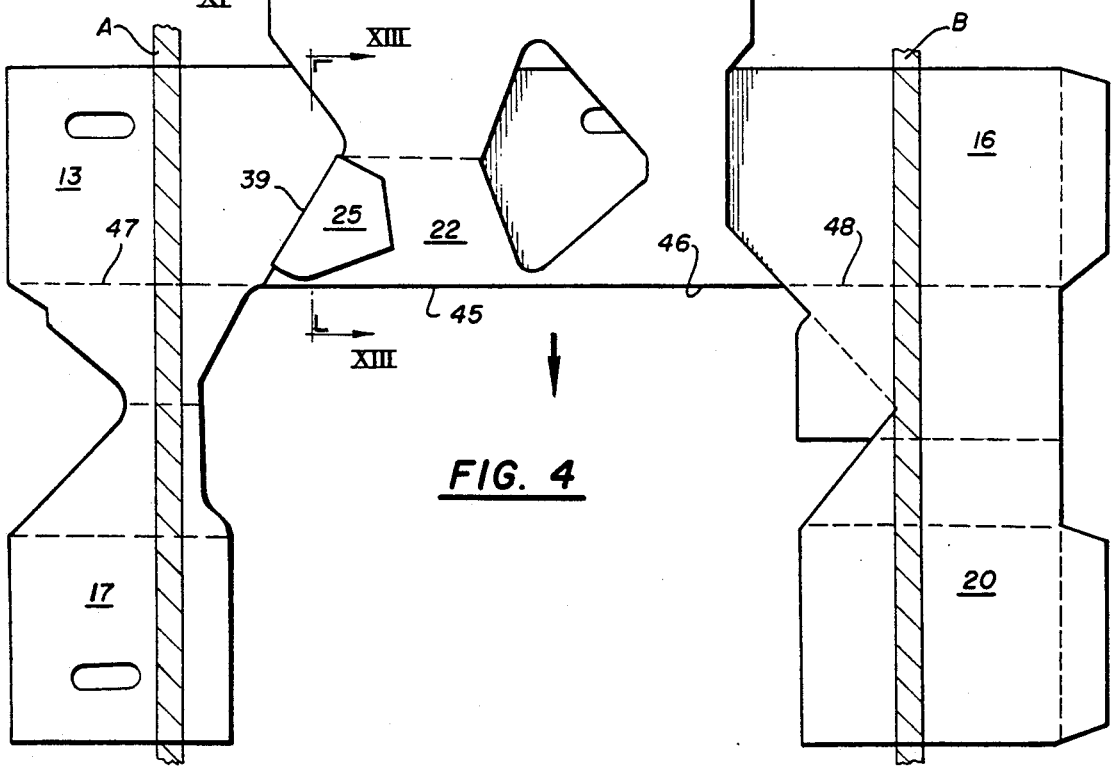

FIG. 4 shows the next step in the manufacture. The belts A and B still press the carton blank forward through the machine and hold down the panels 13 and 17 on one side and the panels 16 and 20 on the other side. During the second phase of the movement, the panels 18, 19 are folded further over about hinge lines 45 and 46 and at the same time the tab 25 is folded laterally about the hinge line 39, so that it comes in contact with the strip 22, particularly the trapezoidal portion which is adjacent the side wall panel 14, one edge which defines the hinge line 39.

Figure 12:
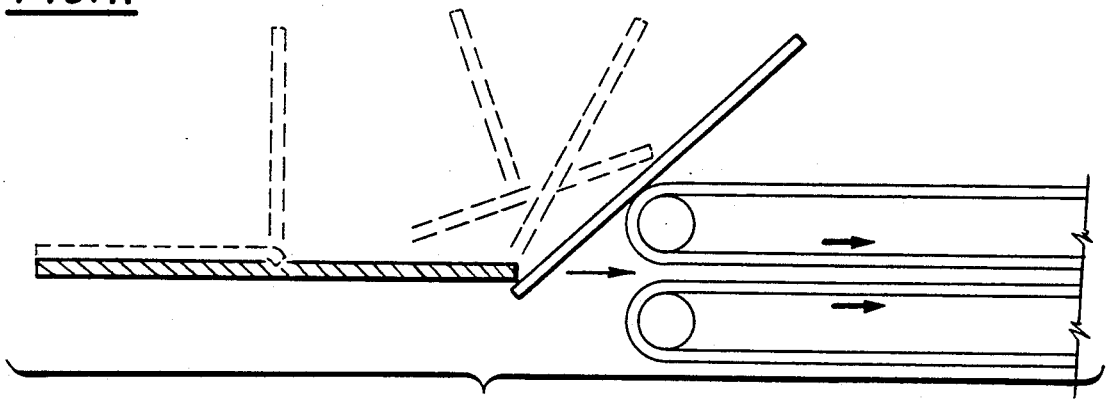

FIG. 12 shows the manner in which the blank is folded about the hinge lines 43 and 44 by running the leading edge of the panel against an inclined plane and then grasping the blank between moving belts to fold them over the hinge lines. The same method is used to further fold the assemblage about the hinge lines 45 and 46.

Figure 13:
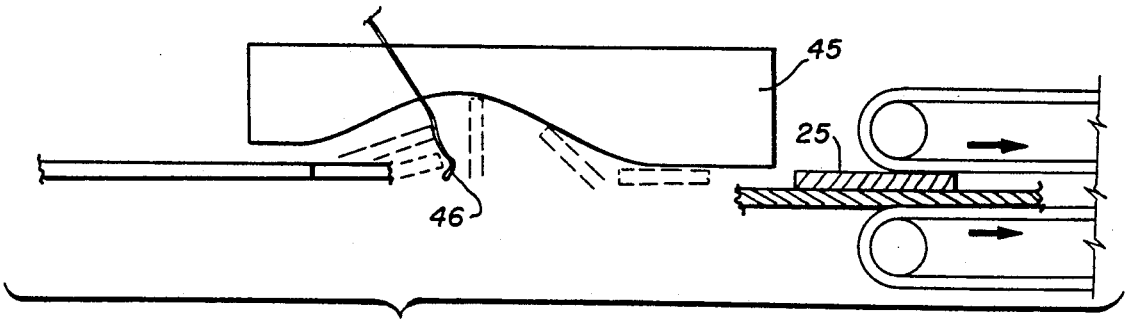
Figure 14:
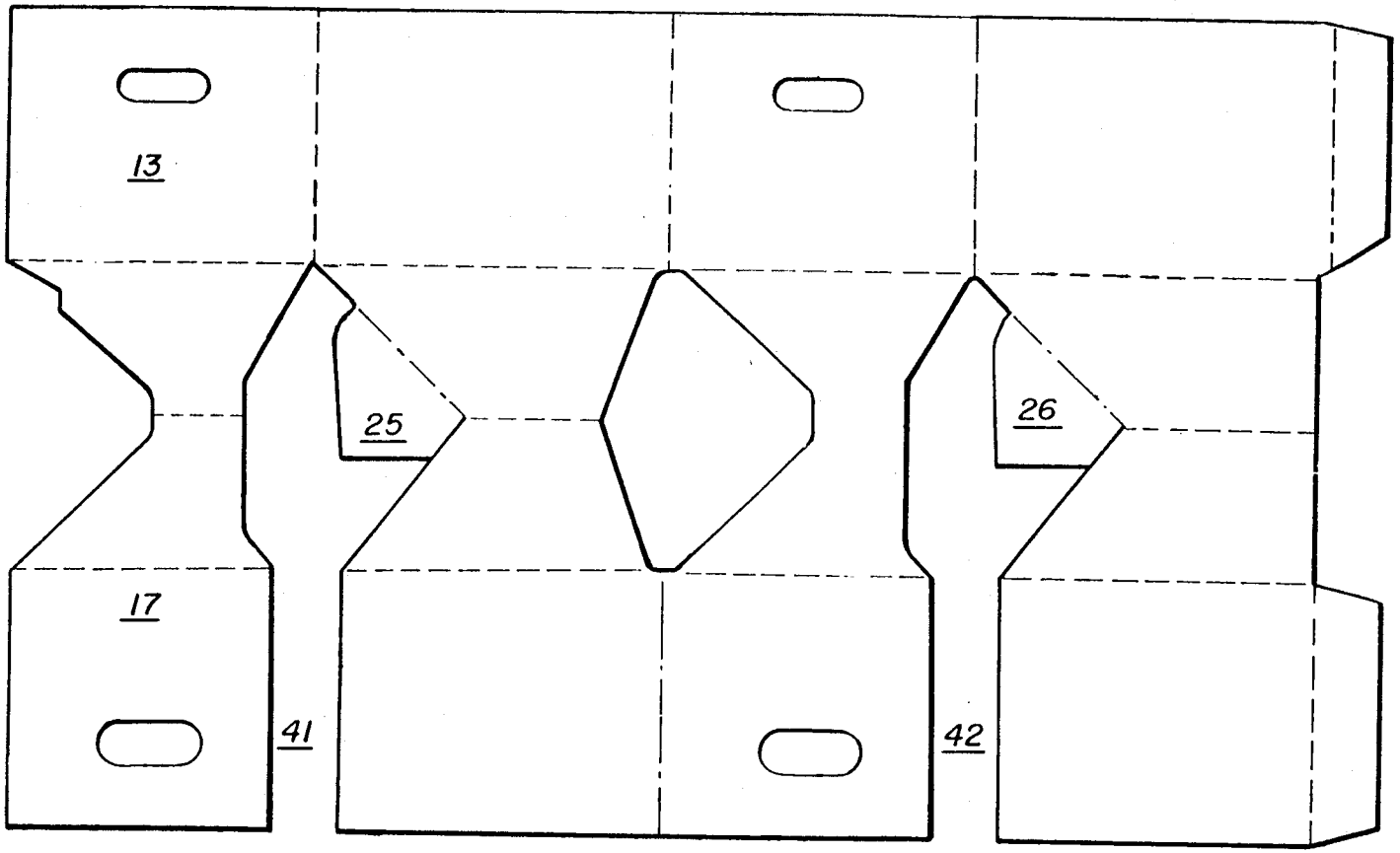
FIG. 14 is a plan view of a specific practical embodiment of the blank from which the carton is formed.

The method that is used to fold the reinforcing tab 25 is shown in FIG. 13 and makes use of a formed cam 45 which lifts the tab and bends it about the hinge line 39 in a complex motion involving a catch hook 46 which catches the leading edge of the tab 25 until it engages the cam 45 which bends it further back until it is in contact with the strip 22.

Figure 5:
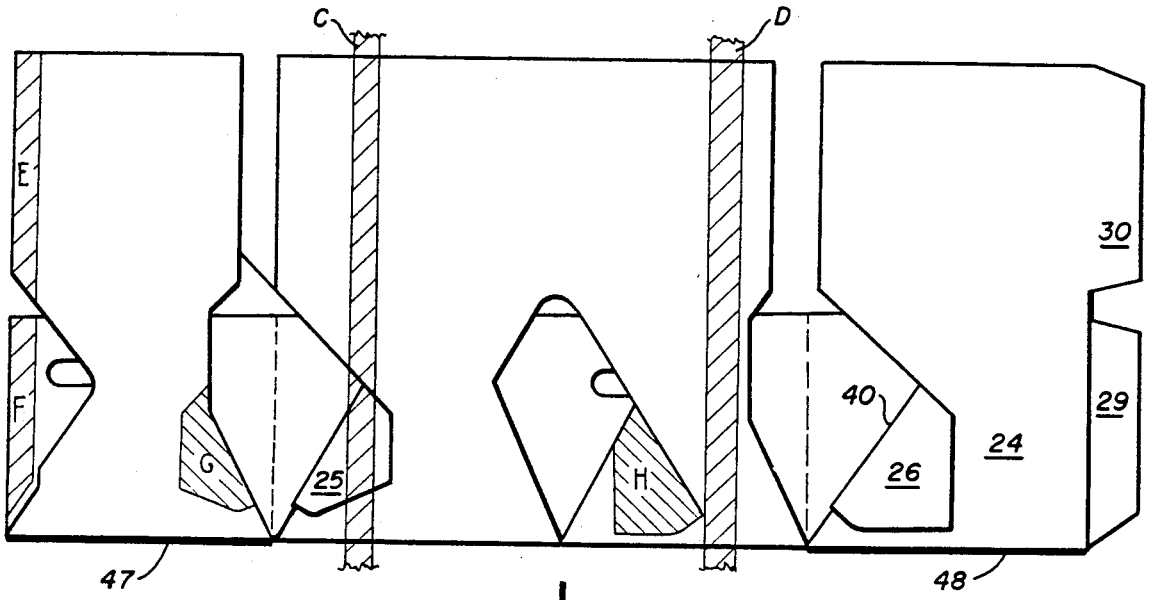

FIG. 5 shows the next step in the process in which the central panels are firmly held on pressure areas C and D and side panels are bent about hinge lines 47 and 48. At the same time, the reinforcing tab 26 is bent about the hinge line 40, so that it lays against the strip 24. This is accomplished in the same way as was illustrated in FIG. 13 for folding back the reinforcing tab 25.

At this point in the process, cement is applied to the blank in the areas E, F, G, and H to provide sites for cementing the tabs 25, 26, 29, and 30.

Figure 7:
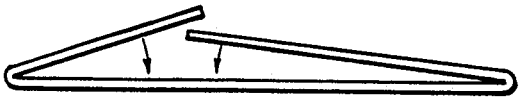
FIG. 7 is a view of the carton blank in the condition shown in FIG. 6 taken on the lines VII—VII of FIG. 6.

In FIG. 6 and 7, it can be seen that the two side groups of panels are folded toward the middle two groups, the right hand group "leading" the left hand group, so that the cemented areas E, F, G, and H come in contact with the surfaces of the tabs 25, 26, 29, and 30. FIGS. 6 and 7 do not show the completed movement but show the folding operation at an intermediate stage. The finished product is shown in FIG. 8 which shows the carton in its non-set-up mode.

Figure 8:
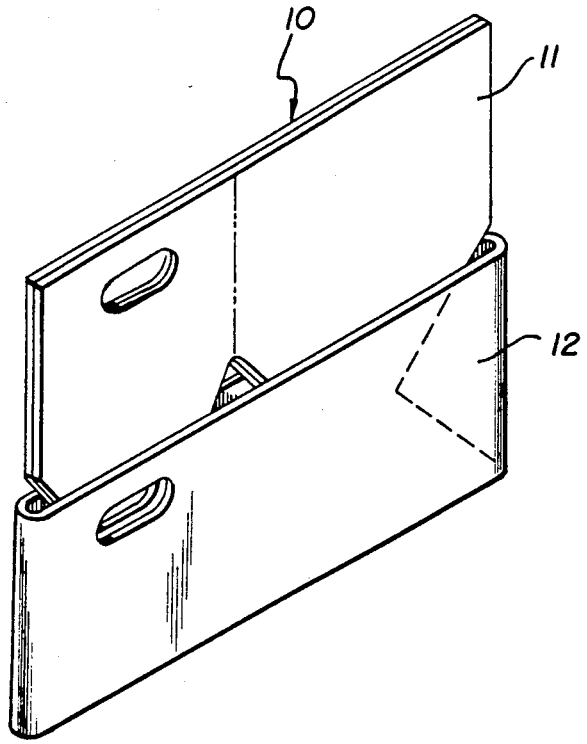
FIG. 8 is a perspective view of the carton in its inoperative flat mode.
Figure 9:
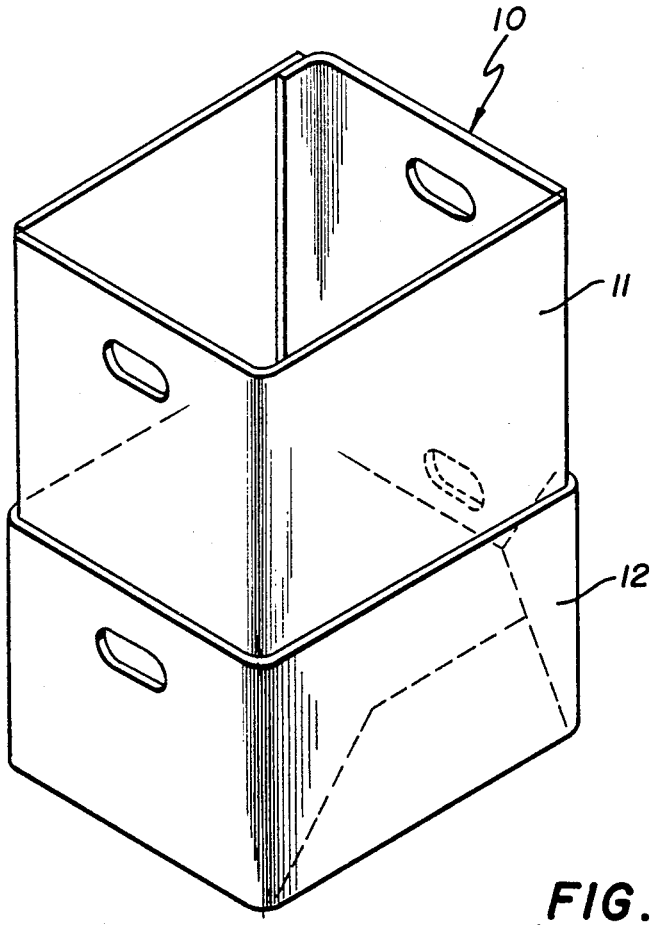
FIG. 9 is a perspective view of the carton in its unset-up mode but with the elements expanded preparatory to moving into its set-up mode.

The movement from the condition shown in FIG. 8 to the intermediate, partial set-up condition shown in FIG. 9, is accomplished by pressing on the lateral sides of the elements to open the inner and outer shells 11 and 12 to the condition shown.

In order to move the carton from the condition shown in FIG. 9 (intermediate mode) to the set-up mode shown in FIG. 1 (set-up mode) is only necessary to press the sleeve 11 downwardly into the sleeve 12. As can be seen in FIG. 10, the reinforcing tabs 25 and 26 are securely fastened to the adjacent strips 21 and 23, respectively.

It can be seen, then, that by use of the present invention it is possible to obtain a carton 10 of extremely great strength, which carton is easily collapsed and easily erected for use at a site with such is useful. The manufacturing process can take place rapidly, because it is a straight-through operation on a more-or-less conventional carton manufacturing machine. There is no need (as was true in the prior art) to glue and fold certain parts of the carton before it could be passed through the machine. Neither is it necessary to turn the carton at right angles to accomplish certain folding operations. In other words, the blank enters the machine without folding and gluing and the apparatus is successfully folded and glued without necessitating stopping or turning; this means that the manufacturing operation can be performed faster.

Furthermore, the operation of moving the completed from collapsed condition to set-up condition takes place easily, because it is not necessary that the inner shell be square with the outer shell when the telescoping operation takes place. Furthermore, there is no possibility of the bottom bulging when loaded, since the construction is stronger even though there are two open corners on the inner sleeve, because the other two corners are reinforced to a four-thickness arrangement.

Figure 11:
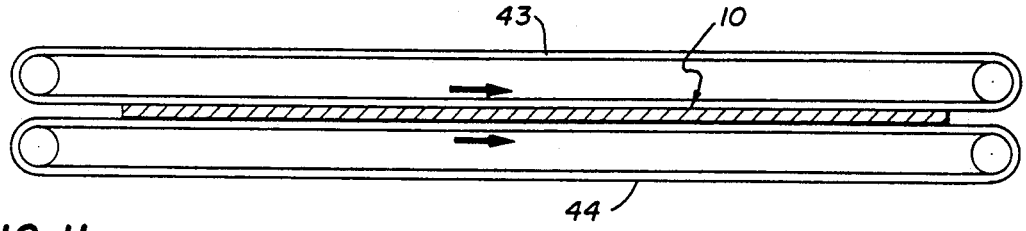
FIGS. 11, 12, and 13 show various steps in the manufacture of the carton.

FIG. 11 illustrates a carton blank of practical use that has actually been constructed and shows the dimensions and angles that exist in a practical embodiment of the invention. It is interesting to note that the edge of the panel 13 is slightly inwardly of the edge of the panel 17 to assist in the construction. The gaps 41 and 42 are in the order of three quarters of an inch. Also the tabs 25 and 26 are provided with offset and slightly inclined edges.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Carton comprising:

(a) inner and outer snugly nesting tubular shells of corrugated board having lines of corrugation, the outer shell consisting of four side wall panels, each panel having two side edges hingedly connected to the side edges of other panels lengthwise of the said lines of corrugation, the inner tubular shell also having four side wall panels, the shells being movable lengthwise into and out of a set-up relatonship in which the side wall panels of the shells are in overlying relationship in sets of two to provide for a double-walled construction, (b) a plurality of foldable strips hingedly connecting adjacent bottom edges of each said set of overlying side wall panels, said strips being unfolded and extensions of their respective side wall panels when the inner shell is non-coextensive with the outer shell, said strips extending transversely of the side wall panels to form a carton floor when said shells are telescoped into set-up relationship, and (c) reinforcing tabs hingedly connected to each of two alternate strips, each tab being fastened to one of the two non-tabbed strips.

2. Carton as recited in claim 1, wherein each of the strips consists of two trapezoidal panels, each having a major base hingedly connected to one of the side wall panels and a minor base edge connected to a corresponding minor base edge of the other of the two trapezoidal panels.

3. Carton as recited in claim 2, wherein each reinforcing tab is of generally quadrilateral shape with one side hingedly connected to an inclined side of one of the trapezoidal panels of the strip to which it is hingedly connected, and wherein each reinforcing tab is fastened by adhesive in face-to-face relationship to the non-tabbed strip to which it is fastened.

4. Carton as recited in claim 1, wherein the four side wall panels of the inner shell are arranged so that two hinged connections are present along certain of the said side edges and are alternated by gaps between two adjacent side edges.

* * * * *